US011820557B2

(12) United States Patent
Grabarczyk et al.

(10) Patent No.: US 11,820,557 B2
(45) Date of Patent: Nov. 21, 2023

(54) TETHERED PLASTIC STOPPER

(71) Applicant: NOVEMBAL USA INC., Edison, NJ (US)

(72) Inventors: Henri Grabarczyk, Gleizé (FR); Stéphane Graux, Liergues (FR)

(73) Assignee: NOVEMBAL USA INC.

( * ) Notice: Subject to any disclaimer, the term of this patent is extended or adjusted under 35 U.S.C. 154(b) by 0 days.

(21) Appl. No.: 17/279,066

(22) PCT Filed: Sep. 23, 2019

(86) PCT No.: PCT/US2019/052505
§ 371 (c)(1),
(2) Date: Mar. 23, 2021

(87) PCT Pub. No.: WO2020/061585
PCT Pub. Date: Mar. 26, 2020

(65) Prior Publication Data

US 2022/0048680 A1 Feb. 17, 2022

Related U.S. Application Data

(60) Provisional application No. 62/735,181, filed on Sep. 23, 2018.

(51) Int. Cl.

| | |
|---|---|
| ***B65D 41/34*** | (2006.01) |
| ***B65D 43/16*** | (2006.01) |
| ***B65D 55/06*** | (2006.01) |
| ***B65D 55/16*** | (2006.01) |

(52) U.S. Cl.
CPC ..... *B65D 41/3428* (2013.01); *B65D 43/16* (2013.01); *B65D 55/16* (2013.01); *B65D 2251/10* (2013.01)

(58) Field of Classification Search
CPC .... B65D 41/3428; B65D 43/16; B65D 55/16; B65D 2251/10; B65D 2251/1066; B65D 2401/40; B65D 41/3423
USPC ..... 215/250
See application file for complete search history.

(56) References Cited

U.S. PATENT DOCUMENTS 4,487,324 A * 12/1984 Ostrowsky ..... B65D 47/0814 215/253
6,116,441 A 9/2000 Decelles et al.
6,481,588 B1 11/2002 Wagner
9,828,146 B2 11/2017 Loukov
(Continued)

FOREIGN PATENT DOCUMENTS

WO WO-2020061579 A1 * 3/2020 ..... B65D 41/24

OTHER PUBLICATIONS

International search report dated Oct. 30, 2019.

*Primary Examiner* — Valentin Neacsu
*Assistant Examiner* — Eric C Baldrighi

(57) ABSTRACT

The present invention relates to tethered plastic stopper having a tamper band having an offset wall, a closure shell having a peripheral wall, and a hinge connected to the closure shell and a bottom edge attached to the tamper band. The closure shell is also separably connected to the tamper band through a weakness line. The peripheral wall extends around a portion perimeter of the stopper forming a first end at one edge of the peripheral wall and a second end edge at the other edge of the peripheral wall. The offset wall extends between the first and second ends of the peripheral wall at the opposite of the hinge.

6 Claims, 3 Drawing Sheets

(56) References Cited

U.S. PATENT DOCUMENTS

| | | | | |
|---|---|---|---|---|
| 10,322,856 | B2 * | 6/2019 | Giraud | B65D 43/162 |
| 2006/0043052 | A1 * | 3/2006 | Lin | B65D 47/0838 215/253 |
| 2006/0163188 | A1 * | 7/2006 | Lagler | B65D 41/16 220/254.5 |
| 2009/0194501 | A1 * | 8/2009 | Yamanaka | B65D 47/0814 220/837 |
| 2014/0312038 | A1 * | 10/2014 | van Alfen | B65D 43/16 220/214 |
| 2021/0316908 | A1 * | 10/2021 | Lamoureux | B29C 45/0081 |

* cited by examiner

TETHERED PLASTIC STOPPER

TECHNICAL FIELD

This present disclosure relates generally to closures for containers. More specifically, the present disclosure relates to a tethered closure secured to a bottle neck.

BACKGROUND

In the field of liquid packaging, it is very common to seal the aperture of a container with a stopper, often made from a plastic material. Such a container is usually a plastic bottle, but other materials may be used as well.

The stopper has a tubular shape closed at its top edge by a top wall. The stopper comprises a roof attached to a tamper shell through bridges. Bridges are distributed around the circumference of the roof and the tamper shall. The bridges may be made when molding the stopper or after through undergoing a cutting step during the manufacturing process.

Usually the bottle neck includes outer fixation feature, such as thread(s) for screw type stopper or annular fixation rings for snap type stopper, to secure the stopper on the bottle neck.

For screw type stoppers, the tamper shell comprises inner thread(s) arranged inside side walls. The bottle neck fixation feature may include outer thread(s). Such combination of outer and inner thread(s) allows the stopper to be screwed on a bottle neck to seal it and unscrewed for bottle opening. A snap type stopper may include an inner annular area and the bottle neck fixation feature may include outer fixation ring, in order to slot in force the stopper on the bottle neck. A snap type stopper may include a tamper shell with a movable sealing roof from a closed position to a partial opening position, and reversely. The roof may be separated upon opening or may be connected to the tamper shell.

In a bottle sealing position of the stopper, the tamper shell may be secured around the bottle neck through inner shell retaining features or through the retaining features diameter being smaller than a diameter of a tamper shell of the bottle neck.

The roof may be removable. During bottle opening, the bridges form a weakness line and may be torn apart from the roof, separating it from the bottle. The weakness line may be torn when user unscrews the tamper shell of the stopper or when user lifts the roof by tilting.

There is a recycling risk with separable roof as consumers may not always screw or snap back the roof onto the bottle neck once empty. The stopper may be thrown away as litter or put into the trash bin, or worse make its way into a landfill, which is not good in view of the environmental considerations.

One solution includes linking the roof to the tamper shell secured on the bottle neck, so the roof stays attached to the bottle after bottle opening. Such an attached stopper may be called a "tethered stopper."

Other known art prior art systems include a tethered stopper comprising a spiral strip. The spiral strip is made during the stopper molding so there is no cutting or slitting operations. Other known prior art systems includes tethered stoppers comprising two strips linking the closure shell to the tamper band secured on the bottle.

SUMMARY

This invention provides an improved tethered plastic stopper where its closure shell remains attached to its tamper band after bottle opening via a linking feature. The attachment is operated through a hinge which connects the tamper band secured on the bottle neck with the closure shell. The periphery of the closure shell extends around a part of the bottle neck, thus allowing the closure shell to be opened even if its lateral periphery partially surrounds the bottle neck.

DESCRIPTION OF DRAWINGS

The figures are not necessarily to scale and some features may be exaggerated or minimized, such as to show details of particular components. Emphasis is placed on illustrating the principles of the invention. In the figures, like reference numerals designate corresponding parts throughout the different views.

DETAILED DESCRIPTION

Figure 1:
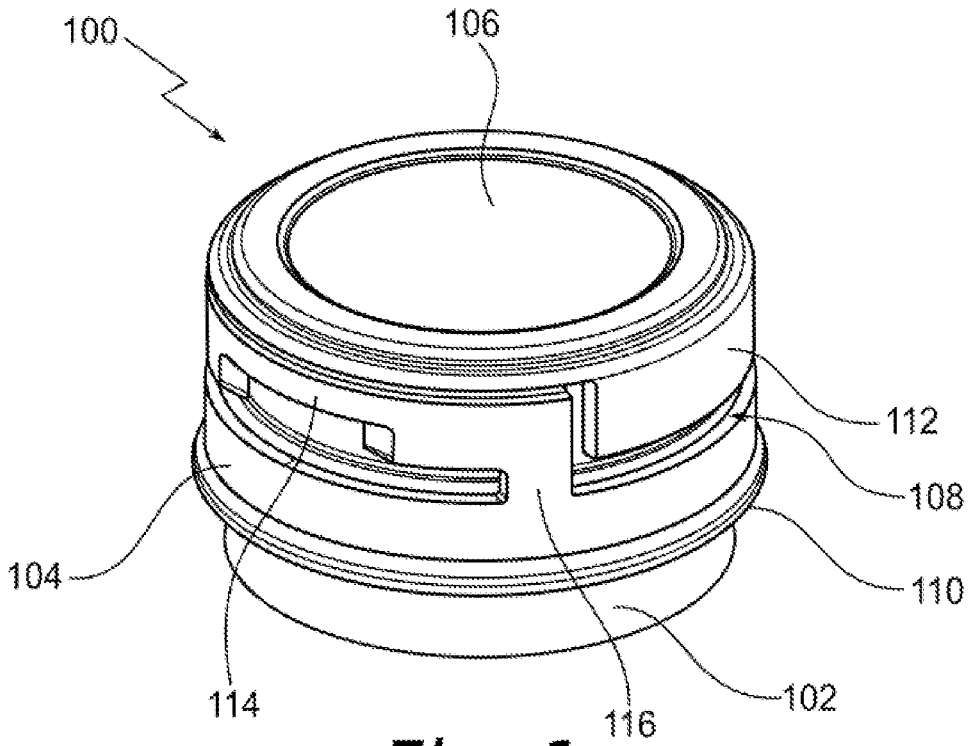
FIG. 1 is a diagrammatic perspective view according to an angular view of an embodiment of a tethered stopper secured on a bottle neck, in a closed position.
Figure 2:
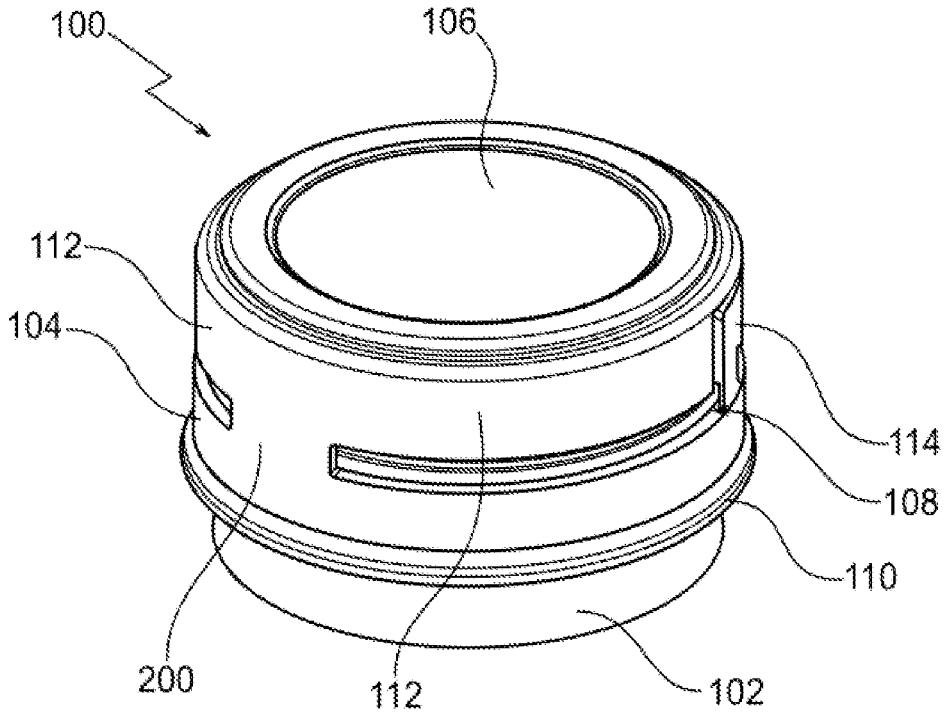
FIG. 2 is a diagrammatic perspective view according to another angular view of an embodiment of the tethered stopper secured on a bottle neck, in the closed position.
Figure 3:
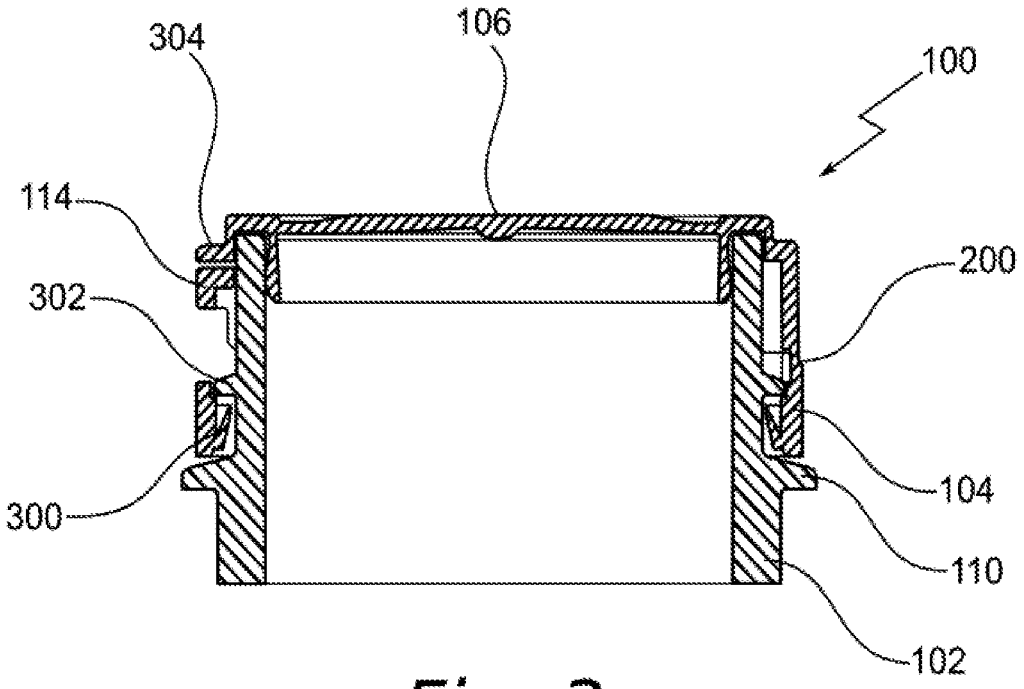
FIG. 3 is a diagrammatic section view of an embodiment of the tethered stopper secured on a bottle neck, in the closed position.

As required, detailed embodiments of the present disclosure are disclosed herein. The disclosed embodiments are merely examples that may be embodied in various and alternative forms, and combinations thereof. As used herein, for example, exemplary, and similar terms, refer expansively to embodiments that serve as an illustration, specimen, model or pattern.

In some instances, well-known components, systems, materials or methods have not been described in detail in order to avoid obscuring the present disclosure. Therefore, specific structural and functional details disclosed herein are not to be interpreted as limiting, but merely as a basis for the claims and as a representative basis for teaching one skilled in the art to variously employ the present disclosure.

Phrasing such as 'configured to' perform a function, including in the claims, can include any or all of being sized, shaped, positioned in the arrangement, and comprising material to perform the function.

Terms indicating quantity, such as 'first' or 'second' are used for exemplary and explanation purposes and are not intended to dictate the specific ordering of a component with respect to other components. Terms indicating position such as 'upper' and 'lower' or 'front' and 'back' are used to indicate components relation to one another. One of skill in the art would recognize other configurations are possible.

Various embodiments of the present disclosure are disclosed herein. The described embodiments are merely exemplary illustrations of implementations set for a clear understanding of the principles of the disclosure. Variations, modifications, and combinations may be made to the described embodiments without departing from the scope of the claims. All such variations, modifications, and combinations are included herein by the scope of this disclosure and the claims.

The invention relates to a tethered plastic stopper 100, for closing a bottle neck 102. The stopper 100 globally has a tubular shape. The stopper 100 is integrally made of one plastic piece by a molding fabrication step. Other parts or elements of the stopper 100 can be further created into the entire plastic piece through a cutting or slitting step during a manufacturing process.

The stopper 100 can be a screw type or a snap type closure. It comprises inner fixation features, such as thread(s) or inner annular ring(s), designed to cooperate with outer complementary fixation features made on the bottle neck 102. The stopper 100 comprises a tamper band 104 and a closure shell 106. The tamper band 104 and the closure shell 106 are linked together, the tamper band 104 being top connected around the bottom of the closure shell 106.

At its bottom edge, the tamper band 104 comprises retaining features 300. These retaining features 300 secure the stopper 100 when sealing the bottle neck 102. The retaining features 300 are made of a collar. After the collar is inverted inside the tamper band 104, in bottle sealing the collar locks the tamper band 104; the stopper 100 against a tamper evident ring 302 is positioned outwardly around the bottle neck 102. The retaining features can also be molded directly from the injection process resulting in beads that do not need to be inverted like the collar.

The bottle neck 102 comprises a transport ring 110 under the tamper evident ring 302. The stopper 100 comprises at least a weakness line 108 between the closure shell 106 and the tamper band 104. The weakness line 108 is made of bridges. The bridges are distributed almost all along the weakness line 108, regularly or not. The bridges link the closure shell 106 to the tamper band 104. Thus, when opening the closure shell 106, the bridges are teared apart from the closure shell 106 and from the tamper band 104. The closure shell 106 can be manually separated by the consumer, in order to open the bottle neck 102.

The closure shell 106 is typically not capable of being easily removed from the rest of the stopper 100. The stopper 100 comprises a hinge 200. The hinge 200 is top attached to the closure shell 106 and bottom attached to the tamper band 104. Hence, when opening, the closure shell 106 stays attached to the tamper band 104 secured on the bottle neck 102 through its retaining features 300. Therefore, the weakness line 108 extends along all the periphery of the stopper 100, except along the hinge 200. The hinge 200 angularly extends from 5° to 90° in reference with stopper periphery.

The closure shell 106 partially surrounds the bottle neck 102. The peripheral wall 112 extends partially around the stopper 100. The peripheral wall 112 of the closure shell 106 angularly extends from 90° to 270°, symmetrically or not relative to the hinge 200 or about 180°. The closure shell 106 has no peripheral wall 112 at the opposite of the hinge 200. As such during opening, the closure shell 106 is moved in rotation around the hinge 200 and the free space at the opposite of the hinge 200 allows the closure shell 106 to be opened without any blocking.

A part of the edge of the closure shell 106 is free at the opposite side of the hinge 200. Such free edge allows the consumer to push under the closure shell 106 in order to open it. In order to prevent inappropriate opening, the stopper 100 comprises an offset wall 114. According to an embodiment, the tamper band 104 comprises the offset wall 114 and the offset wall 114 upwardly extends from the top end of the tamper band 104, around the free gap between the ends of the closure shell peripheral wall 112. The offset wall 114 can also extend from the bottom of the closure shell 106 if desired. The offset wall 114 can fill the empty space, avoiding the edge of the closure shell 106 being pushed up and opened. The offset wall 114 can angularly extends from 90° to about 270°.

Figure 5:
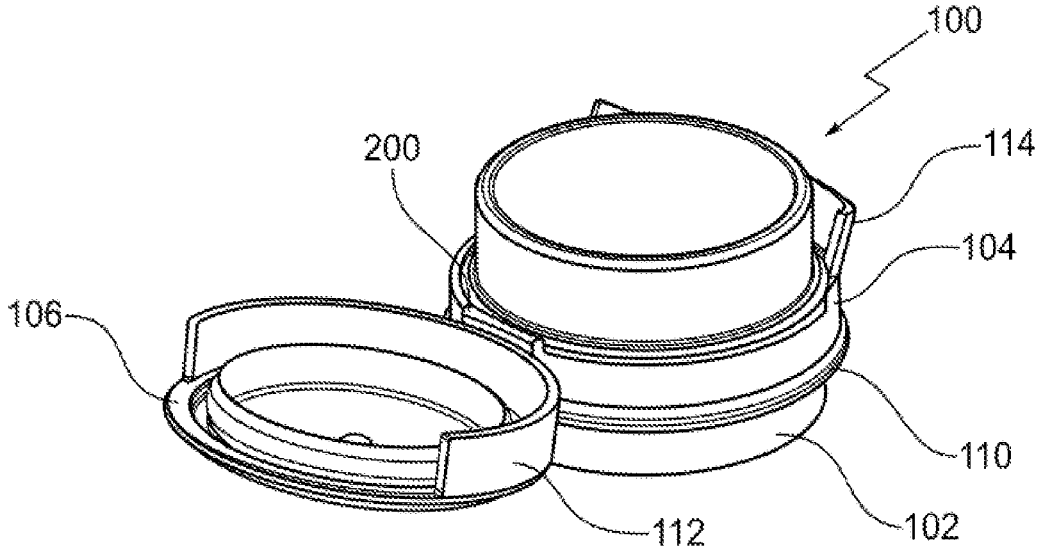
FIG. 5 is a diagrammatic perspective view according to another angular view of an embodiment of the tethered stopper secured on a bottle neck, in the opened position.
Figure 6:
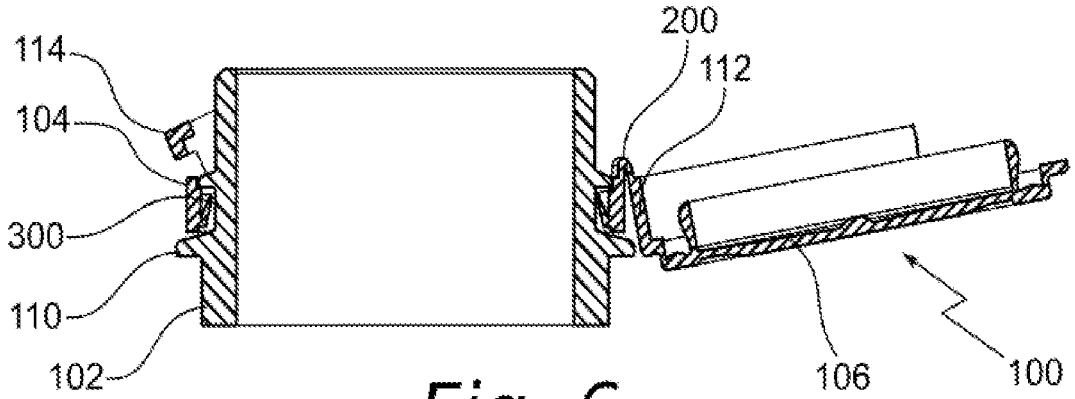
FIG. 6 is a diagrammatic section view of an embodiment of the tethered stopper secured on a bottle neck, in the opened position.
Figure 7:
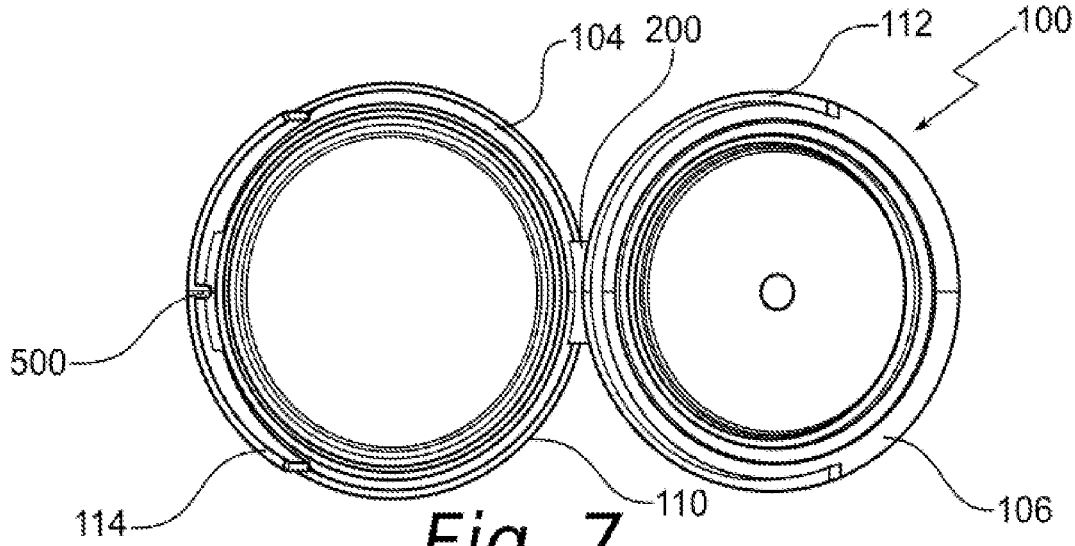
FIG. 7 is a diagrammatic top view of an embodiment of the tethered stopper secured on a bottle neck, in the opened position.

The offset wall 114 can be moved by the consumer from a blocking position of the closure shell 106 to an unlocked position allowing the closure shell 106 to be freely manipulated by the consumer. Therefore, the bottom of the offset wall 114 comprises at least one pivot line 116 where the two pivot lines 116 can be separated by a free space. Hence, the offset wall 114 can be moved in rotation around the pivot line 116, because of the resilience and the elasticity of the plastic material, allowing the offset wall 114 to be manually pulled away from the stopper 100 and the bottle neck 102 by the consumer, in an outwardly inclined way, such as shown in FIGS. 5 and 6. The offset wall 114 can be manually pushed against the stopper 100 and the bottle neck 102 by the consumer, in an inwardly inclined way: hence the top of the offset wall 114 pushes under the edge of the closure shell 106, allowing the opening or helping for the beginning of the opening.

When the consumer releases the offset wall 114, it comes automatically back in the blocking position, due to the elasticity of its plastic material. In order to pull the offset wall 114, the consumer can insert a finger or a nail into the free space between the two pivot lines 116. The offset wall 114 can also have a generally inverted U-shape. Although not shown, the top edge of the offset wall 114 may comprises an outer tongue for helping the consumer to push or pull on the offset wall 114. Thus, as shown in FIG. 1, the weakness line 108 extends from both sides of the hinge 200, under and along the bottom edge of the peripheral wall 112 of the closure shell 106, upwardly vertically or inclined on both sides of the offset wall 114 of the tamper band 104, and along and above the offset wall 114.

Figure 4:
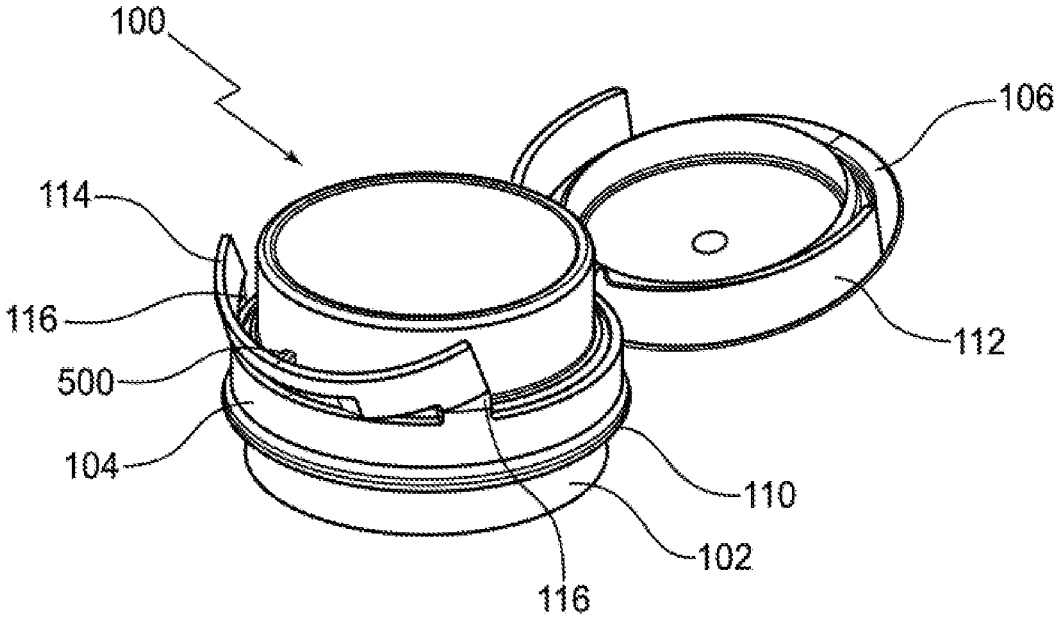
FIG. 4 is a diagrammatic perspective view according to an angular view of an embodiment of the tethered stopper secured on a bottle neck, in an opened position.

As shown in FIG. 4, the offset wall 114 comprises at its top edge at least a junction bridge 500 with the bottom of the closure shell 106. Each junction bridge 500 can be broken when first pushing or pulling on the offset wall 114. The junction bridge 500 can be used as tamper evidence for the consumer to check that the bottle was not previously opened. When opening the stopper 100, the consumer pulls on the offset wall 114, with a finger, sharp object or a nail, the consumer can upwardly push on the closure shell 106, especially on the bottom of the border 304 outwardly extending from the bottle neck periphery.

The stopper 100 according to the invention offers an improvement as a tethered stopper for closing a bottle neck 102, with a closure shell 106 only partially surrounding the stopper 100. The stopper 100 has an esthetic and compact generally tubular shape when closed.

While various embodiments of the invention have been described, it will be apparent to those of ordinary skill in the art that many more embodiments and implementations are possible that are within the scope of this invention.

What is claimed is:

1. A tethered plastic stopper, comprising:

a tamper band comprising an offset wall;

a closure shell separably connected to the tamper band through a weakness line, the closure shell comprising a peripheral wall extending at least a portion around a perimeter of the stopper forming a first end at one edge of the peripheral wall and a second end edge at the other edge of the peripheral wall, wherein the weakness line extends under and along a bottom edge of the peripheral wall and along and above the offset wall; and a hinge attached at a bottom portion to the tamper band and attached at a top portion to the closure shell, wherein the peripheral wall comprises a gap between the first and second ends such that the offset wall fills the gap when the closure is in a closed position forming a blocking position, and wherein a bottom portion of the offset wall comprises at least one elastic pivot line positioned on either infero-lateral edge of the offset wall such that the offset wall can be pulled downward to an unlocking position during opening without detaching from the tamper band and such that the offset wall returns to the blocking position when released.

2. The tethered plastic stopper according to claim 1, wherein the first end and second end causes the peripheral wall to extend angularly from 90° to 270° around a perimeter of the stopper.

3. The tethered plastic stopper according to claim 2, wherein the first end and second end causes the peripheral wall to extend angularly 180° around a perimeter of the stopper.

4. The tethered plastic stopper according to claim 1, wherein the bottom of the offset wall comprises two pivot lines separated by a free space.

5. The tethered plastic stopper according to claim 1, wherein the weakness line extends from both sides of the hinge, under and along the bottom edge of the peripheral wall of the closure shell, upwardly vertically or inclined on both sides of the offset wall of the tamper band, and along and above the offset wall.

6. The tethered plastic stopper according to claim 1, wherein the offset wall comprises at its top edge at least a junction bridge with the bottom of the closure shell.

* * * * *